US008540585B2

(12) United States Patent
Robinson

(10) Patent No.: US 8,540,585 B2
(45) Date of Patent: Sep. 24, 2013

(54) GOLF CLUB HANDLE SUPPORT DEVICE

(76) Inventor: Gary G. Robinson, Ontario (CA)

( * ) Notice: Subject to any disclaimer, the term of this patent is extended or adjusted under 35 U.S.C. 154(b) by 211 days.

(21) Appl. No.: 12/894,443

(22) Filed: Sep. 30, 2010

(65) Prior Publication Data

US 2011/0306436 A1 Dec. 15, 2011

(51) Int. Cl.
*A63B 55/10* (2006.01)

(52) U.S. Cl.
USPC ..... 473/282

(58) Field of Classification Search
USPC ..... 473/282, 286; 24/566, 567
See application file for complete search history.

(56) References Cited

U.S. PATENT DOCUMENTS 4,805,911 A 2/1989 Ferlazzo et al.
4,862,970 A * 9/1989 Hlavacek ..... 172/378
4,991,839 A 2/1991 Lumbattis, Jr.
D368,589 S * 4/1996 Guio ..... D32/61
5,624,328 A 4/1997 Lovich
6,390,931 B1 5/2002 Berndt
6,482,103 B1 11/2002 Vache
7,351,156 B1 * 4/2008 Panneri et al. ..... 473/132
D612,159 S * 3/2010 Lehr et al. ..... D6/328
2003/0024082 A1 * 2/2003 Seymour ..... 24/546

* cited by examiner

*Primary Examiner* — Stephen L. Blau
(74) *Attorney, Agent, or Firm* — Thomas E. Sisson, PLLC

(57) ABSTRACT

A golf handle supporting device (10) having a proximate end (20) and a distal end (30) for resting on a ground surface as oppose to getting the club handle wet or dirty. A first arm (40) extending in a first direction from a proximate end (20) and a second arm (50) extending from the proximate end (20) in a second direction offset from the first direction; the first arm (40) and second arm (50) each defining a mid-portion comprising a first bend (60) and a second bend (70) which extend downwards in the direction of the ground and terminate at an end of their respective first arms (40) and (50); a first leg (80) and a second leg (90) extending from their respective ends (60) and (70) to the distal ends (30) and generally widen outwards to provide further support.

13 Claims, 7 Drawing Sheets

GOLF CLUB HANDLE SUPPORT DEVICE

FIELD OF THE INVENTION

The present invention relates to a device for use with the hand grip of a golf club, such that it the hand grip does not come in contact with the ground.

BACKGROUND OF THE INVENTION

During play a golfer will often take more than one club out of the golf bag and walk towards the location of the golf ball. While one club is being used, the other club or clubs are put on the ground. However, the hand grip of the club will become wet due to rain, dew or watering of the course which normally includes chemical laden water, thereby affecting the golfer's ability to properly hold and use the club and inadvertently leaving chemical residue on the club handle.

U.S. Pat. No. 6,482,103 B1 (Nov. 19, 2002) to Vache Raymond, E., teaches a way to prevent the hand grip of a golf club from touching the surface of the grass by providing a complex and expensive to manufacture assembly for propping the golf club hand grip up off the ground. The telescoping assembly moves in and out of a retainer that fits within a vent hole in the golf club grip. However, this device has drawbacks of complexity, making it undesirable to use.

SUMMARY OF THE INVENTION

The present invention overcomes the deficiencies of the prior art. In particular, the present invention includes a golf club hand grip and a spring clip device for use therein which maintains the hand grip of the golf club up off the ground in an advantageous manner and which is easy to use. The invention includes a spring clip device that partly slides in and out of the club hand grip and splays open in a fork like manner on to the ground thereby supporting the golf club handle grip up off the ground.

In a broad aspect the invention seeks to provide a supporting device for use with a golf club having a proximate end and a distal end, at least one arm extending in a forward direction from the proximate end defining a mid-portion comprising at least one stop means; and a first leg and a second leg extending both extending in a forward direction from the stop means to the distal end.

A further aspect of the present invention provides for a supporting device for use in cooperation with a golf club shaft having a proximate end and a distal end, a first arm extending in a first direction from the proximate end and a second arm extending from the proximate end in a second direction offset from the first direction; a first leg and a second leg extending from the respective said first arm and second arm and at least one of said arms including a stop means at a juncture with the leg associated with said at least one arm.

Yet further still an aspect of the present invention provides for a supporting device for use in cooperation with a golf club shaft having a proximate end and a distal end with a first arm extending in a first direction from the proximate end and a second arm extending from the proximate end in a second direction offset from the first direction. A distal portion of the first arm and a distal portion of the second arm each defining a stop means. A first leg and a second leg of the device extending from their respective stop means of said first arm and second arm.

Another aspect of the present invention provides for a device supporting a handle of a golf club up off a ground surface, the device has at least two distal ends and a proximate end, the distal ends including retaining members thereon for releasably retaining the device inside the golf club handle when not in use or for supporting the handle of the golf club up off ground.

Yet further the invention also comprehends for a support device including a distal end and a proximate end, a first arm extending in a first direction from the proximate end and a second arm extending from the proximate end in a second direction offset from the first direction, both arms gradually extending outwards and apart from one another from the proximate end to the distal end; the first arm and second arm each defining a mid-portion comprising a first bend and a second bend. The first bend of the mid-portion bending upwards at a predetermined angle towards the second bend which extends downward at a predetermined angle into a curved first leg and a curved second leg terminating at the distal ends. An embodiment of the present invention provides for the distal ends having a contact retaining member thereon. The mid-portion can be used for releasably retaining the device within the golf dub handle.

In a preferred embodiment the present invention provides for the supporting device being constructed of wire and bends in the wire are preferably used as stop means. The configuration of the device being such as to prevent rattle when the device is in a retracted position in the shaft.

Another embodiment of the invention provides for a method for supporting the golf club handle up off the ground by partially retracting or pulling the device out from the golf club handle causing widening of a gap between the mid-portion and the respective first and second antis and legs; and placing the distal ends on the ground for supporting the golf club handle up off the ground.

BRIEF DESCRIPTION OF THE DRAWINGS

The invention both as to its structure and method of use, together with further aspects and advantages thereof, may be best understood by reference to the accompanying drawings.

DETAILED DESCRIPTION OF THE EMBODIMENTS

The present invention will now be described more fully with reference to the accompanying drawings in which preferred embodiments of the present invention are shown.

The invention may however, be embodied and applied and used in different articles where the need exists to keep hand held articles up off the ground for keeping those articles dry for ease of use. Accordingly, the present invention should not be construed as limited to the embodiments set forth herein.

Figure 1:
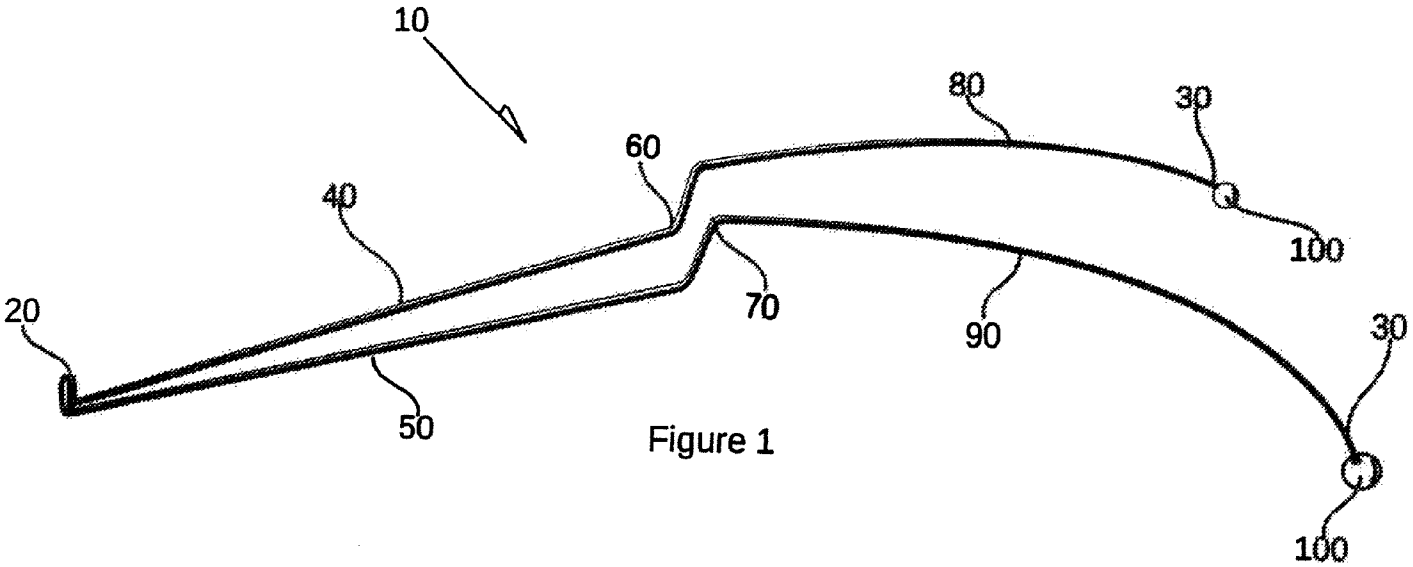
FIG. 1 is a perspective view of a device in accordance with the present invention.

FIGS. 1-6 illustrate the present invention. FIG. 1 shows a device 10 of the present invention. The device 10 includes a proximal end 20 and a distal end 30 defining therebetween a first arm 40 and a second arm 50 extending outwards from the proximal end 20 in a length-ways direction widening apart to a respective mid-portion defined by a first bend 60 and a second bend 70. A first leg 80 and a second leg 90 extend outward from their respective bends 60 and 70 to their distal ends 30 defined by feet 100. The device 10 can be made of man-made or natural materials, for example metal or carbon composites. Preferably, the material of the device 10 is a spring steel. The number and length of arms or legs used can vary and should not be restricted to just the two. The device 10 can be manufactured as a strip of resilient or spring like material having a predetermined length and folded at a mid point over a chosen range of non-limiting angles to two lengths in a splayed "V" shaped, the lengths are preferably equal in dimension.

Figure 2:
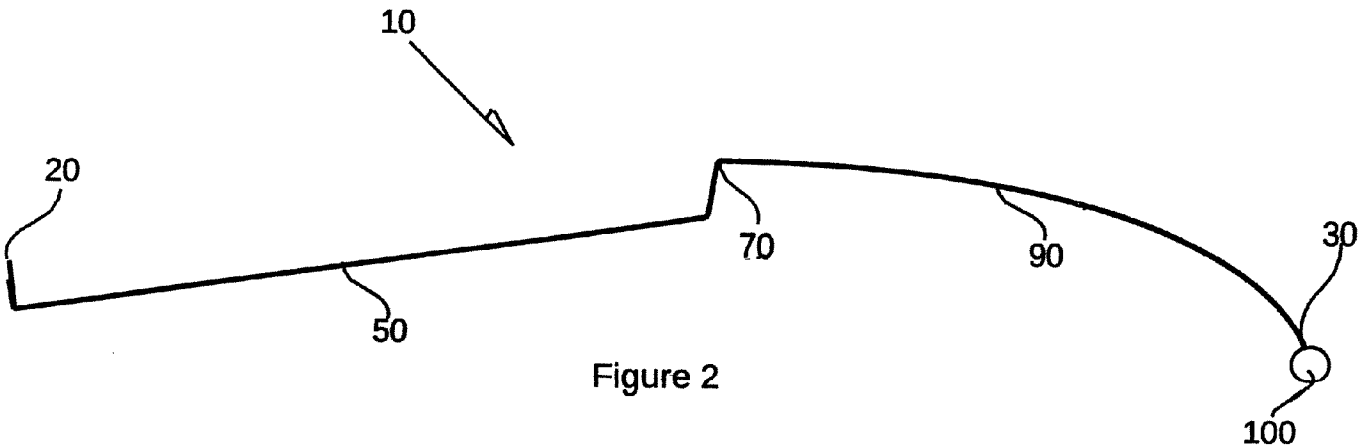
FIG. 2 is a cross-sectional side view of the invention of FIG. 1.

As shown in FIG. 2, the device 10 has a distinct curve from the first bend 60 and second bend 70 along a length of the legs 80 and 90 terminating at the distal end 30 whereon the feet 100 appear on the same plane as the proximate end 20 of the first and second arms 40 and 50. As a consequence of the curvature of the legs 80 and 90 and a raised proximate end 20 and distal end 30, the mid-portion is the highest point of the device 10 when viewed sideways. The curvature of the device 10 provides a resilient, flexibility for use in the environment of the present invention.

Figure 3:
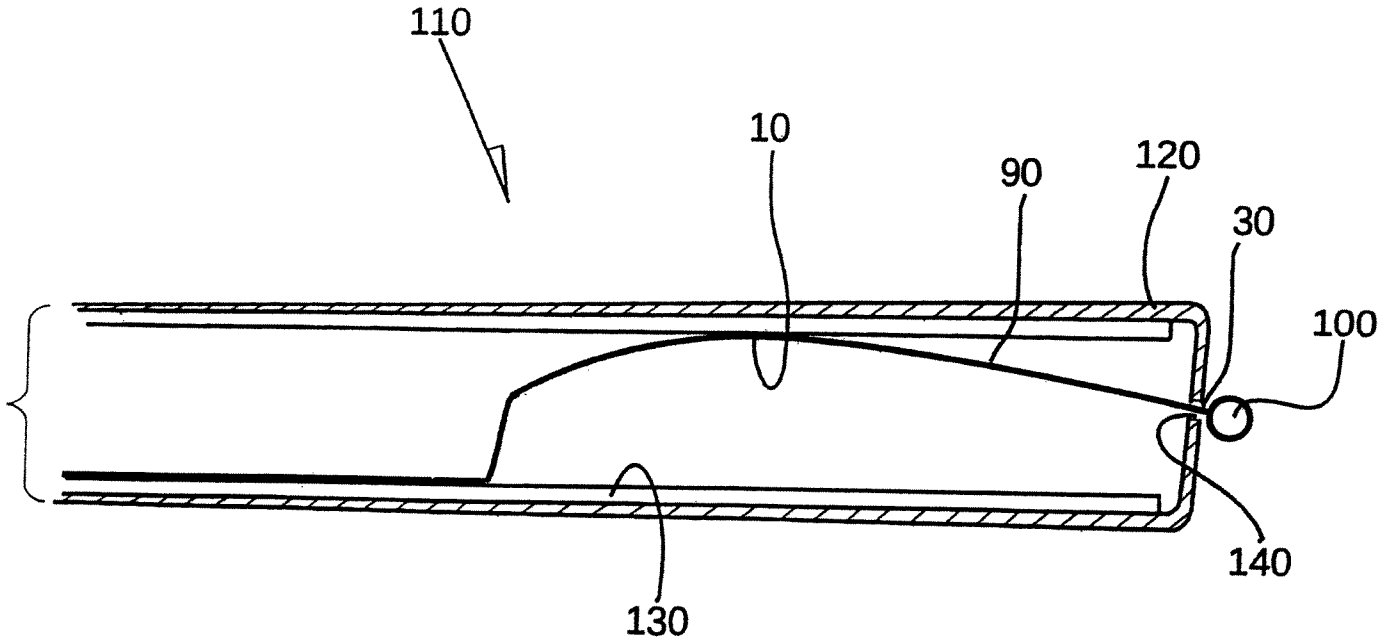
FIG. 3 is a cross-sectional side view of the invention shown of FIG. 1 and FIG. 2 inside a golf club handle.

Referring to FIG. 3, the device 10 is shown inside a golf club handle 110, shown here with grip 120, in and up against an inside of a golf club shaft 130. The curvature and resilient flexible feature of device 10 is forced against the inside of the club shaft 130 to prevent unnecessary movement and distraction during a golf swing. The forced tight fit is relieved by pulling the device 10 outwards to a desired length via the feet 100, through an aperture 140 of the grip 120.

In use as shown in FIGS. 3-6, the golf club handle 110 including the handle grip 120 covering the shaft 130 of the golf club (partially shown) provides an environment within which the proximate ends 30 of the device 10 are pulled from the handle grip 120 dependent upon the varied environments encountered. The aperture 140 of the grip 120 prevents the feet 100 from easily entering in to the shaft 130. As shown in FIG. 3, the curvature of the device 10 provides the appropriate force against the narrow dimensioned shaft 130 and in doing so the flexible material of the device 10 forces the legs 80 and 90 up against an inside of the shaft 130 which in turn also forces down the first arm 40 and second arm 50 onto the shaft 130 interior. More force is exerted from the curvature of the flexible device 10 abutting up against the shaft 130 by having the distal end 30 releasably secured in the aperture 140 of the grip 120 end.

Figure 4:
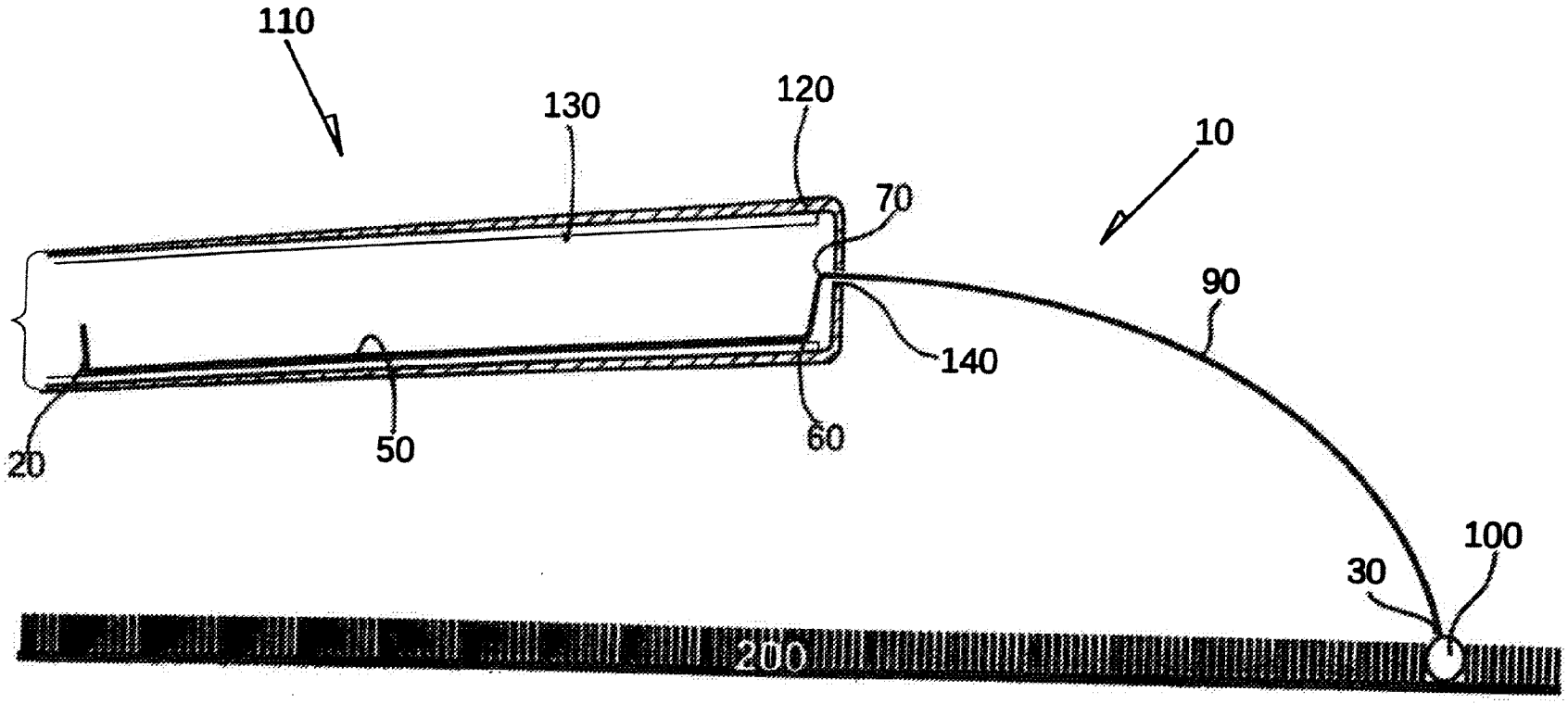
FIG. 4 is a cross-sectional side view of the device in accordance with the present invention extending out from the golf club handle.

Referring to FIG. 4, from the retracted position, the device 10 is partially extended from the shaft 130 through the aperture 140 and on to the ground surface 200. The first bend 60 acts as a stopper against any further outward directional movement of the shaft 130. Preferably the first bend 60 through the aperture 140 acts as a pivotal point of the device 10 for allowing upward and downward directional movements about the inside of the shaft 130 as a means to uphold the golf club handle and club therefore up off the ground surface 200. More preferably, as the feet 100 engage the ground surface 200 the legs 80 and 90 are forced upwards which in turn, forces the arms 40 and 50 downwards on to the interior of the shaft 130 via the pivotal action of the first bend 60 against the aperture 140 and the abutting action of the second bend 70 against the inside of the shaft 130.

Figure 5:
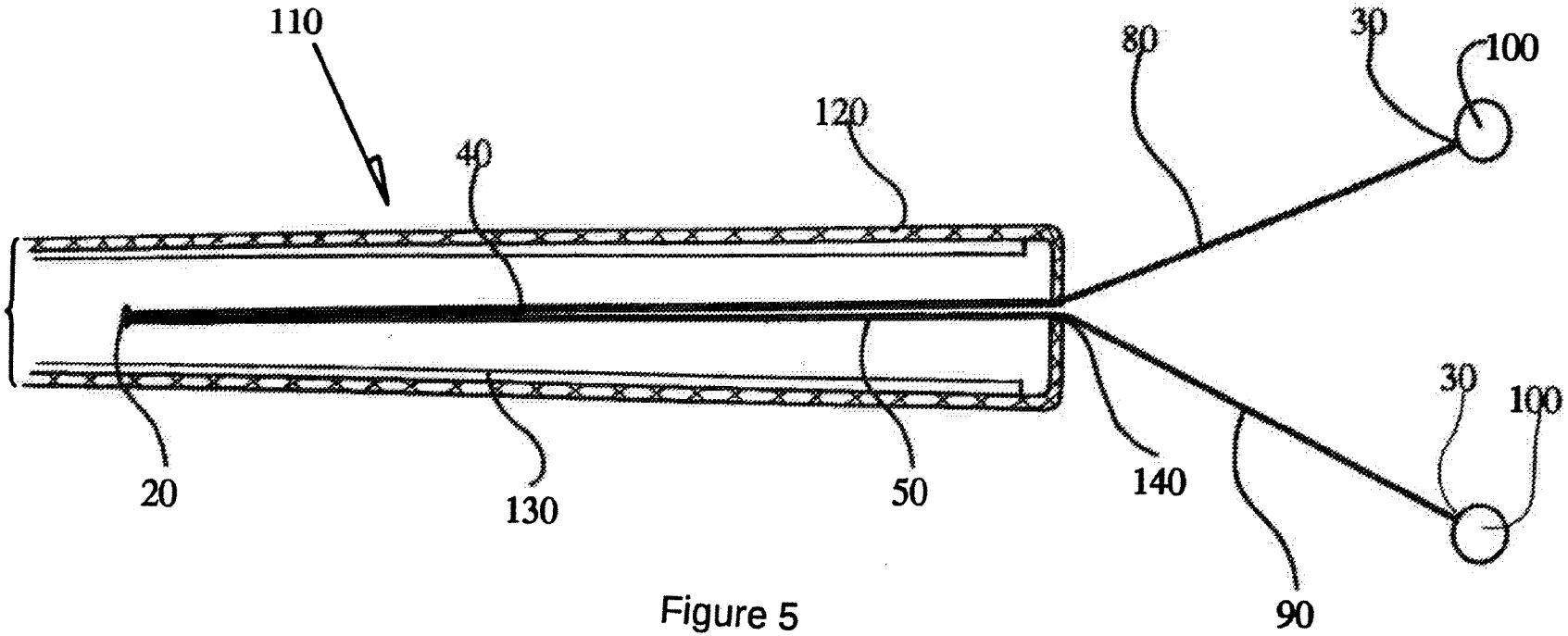
FIG. 5 is a top plan cross-sectional view of FIG. 4.
Figure 6:
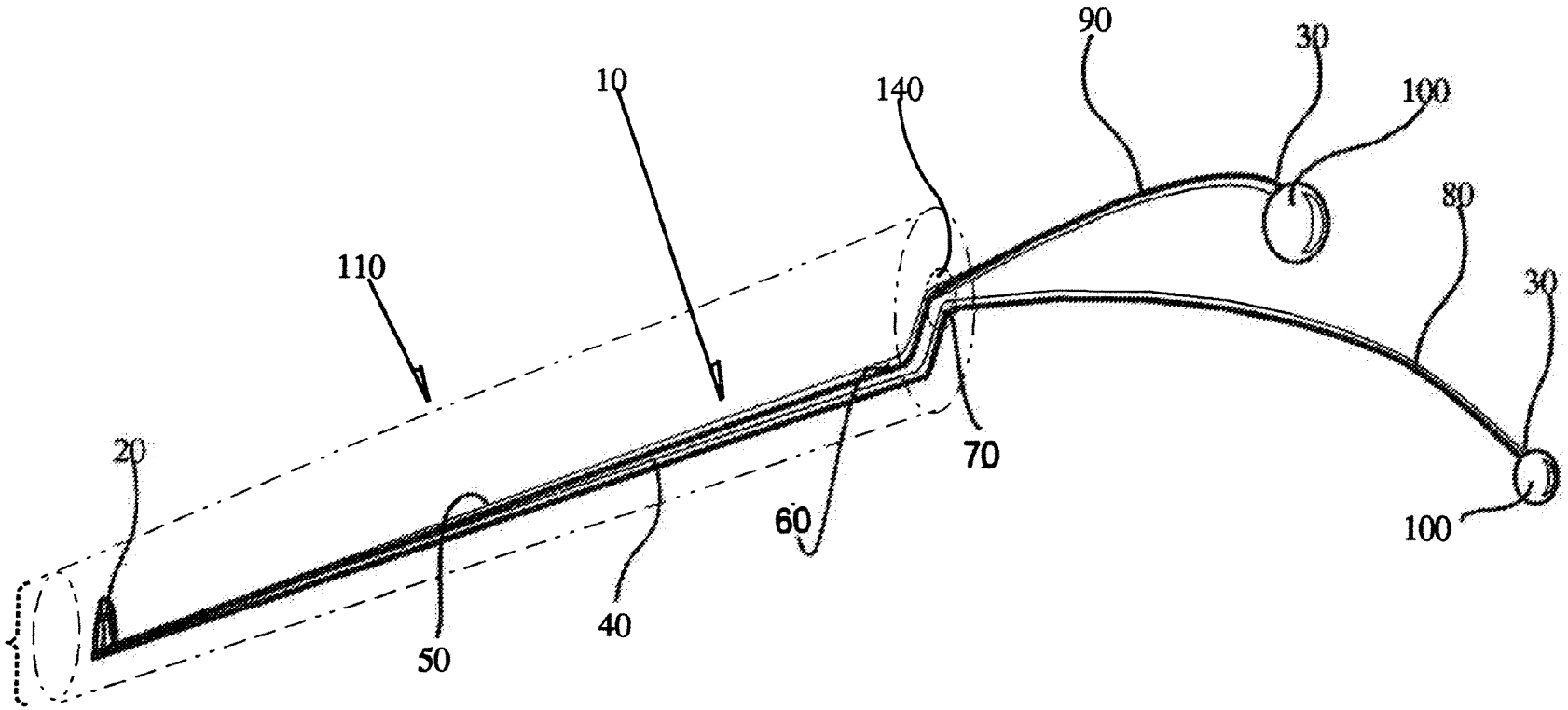
FIG. 6 is a forward elevation view of the device shown in FIG. 4 and FIG. 5.

The top plan cross-sectional view of the device 10 shown in FIG. 5, in a extended position being partially pulled out of the golf club handle 110, via the aperture 140, thereby showing how the fork like first and second legs 80 and 90 respectively with their distal ends 30 with their feet 100 are splayed outwards and downwards onto the ground surface 200 for providing stable support for the club handle 110 of the club. Optionally, depending on the height of the grass or firmness of sand, the device 10 as pulled from the handle 110 can be varied in length to accommodate for the varied environments encountered, for example high grass or wet soaked areas. The feet 100 are preferably made of a predetermined size and shape for ease of use. For example, each foot 100 can be of a dimension and shape such as laterally outwardly directed feet so as to abut the other foot 100 to increase a contact area between each other when the device is retracted within the handle. As a preferred embodiment at least one of the feet 100 is magnetic and firmly engages the other foot 100 to further prevent "rattling". FIG. 6 shows the device 10 engaged within the golf club handle 110, shown as an outline in dotted lines, to further emphasize the working of the mid-portion i.e. the first bend 60 and second bend 70 working around the aperture 140 and shaft 130.

Figure 7:
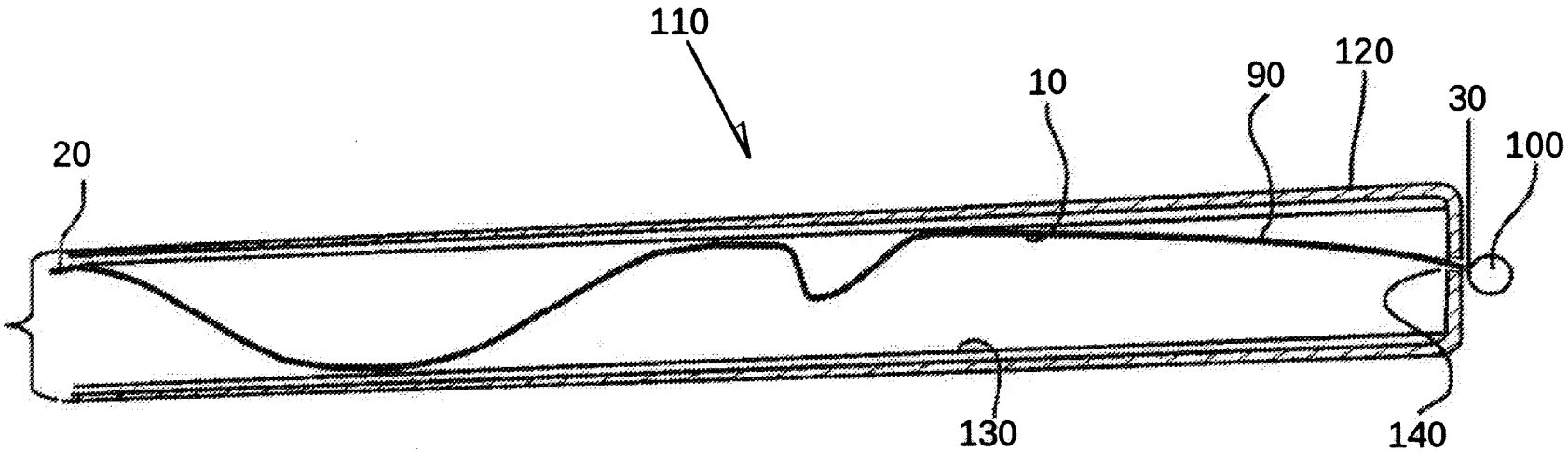
FIG. 7 is a cross-sectional side view of the invention shown of FIG. 1 and FIG. 2 inside a golf club handle illustrating a preferred embodiment of the present invention.
Figure 8:
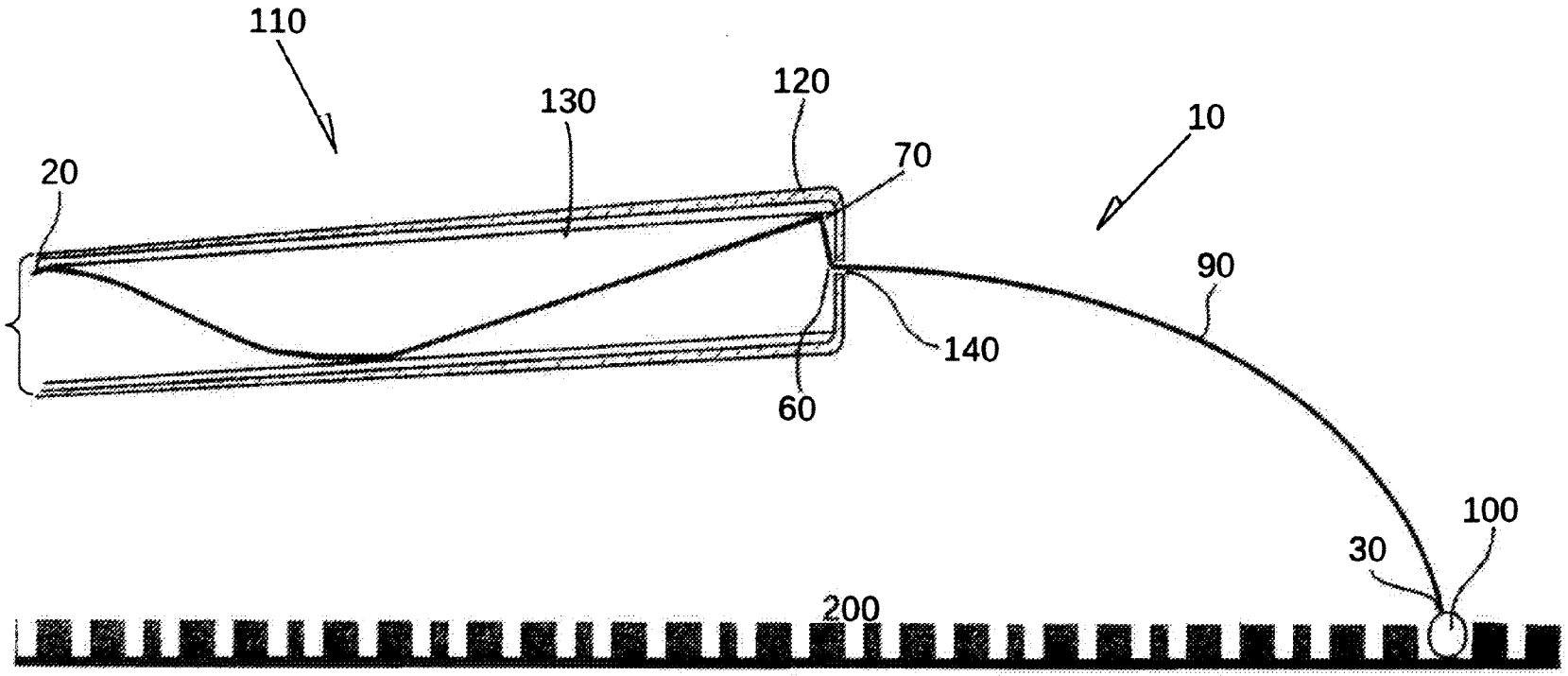
FIG. 8 is a cross-sectional side view of the device in accordance with the present invention extending out from the golf club handle illustrating a preferred embodiment of the present invention.

Referring to FIGS. 7 and 8 there is illustrated the support device 10 with a slightly varied configuration and profile wherein the device 10 functions similar to that shown in FIGS. 1-6 but reflects an alternative to the configurations of the device 10 to enhance the functional contact with the interior 130 of the shaft and to prevent "rattle" of the device 10 when retracted into the shaft 130.

The ease of use of the device 10 of the present invention is further apparent when taking into consideration the structure and function of existing devices which either appear to rely on only one small surface area for resting on the ground or in some instances for penetrating the ground surface. In contrast, the present invention applies at least a two pronged approach for providing the required stability not found elsewhere and with the ease and convenience of use and having proximate ends with retaining members of a design choice and function.

Although the invention has been described above by reference to certain embodiments of the invention, the invention is not limited to the embodiments described above. Modifications and variations of the embodiments described above will occur to those skilled in the art in light of the above identified teachings.

The invention claimed is:

1. A supporting device for use in cooperation with a golf club shaft comprising:

a proximate end and a distal end, a first arm extending in a first direction from the proximate end and a second arm extending from the proximate end in a second direction offset from the first direction; and a first leg and a second leg extending from the respective said first arm and said second arm and at least one of said arms including a stop means at a juncture with the leg associated with said at least one arm, and intermediate the proximate end and the distal end, wherein the device is constructed of wire and bends in the wire are said stop means and wherein the configuration of the device is such as to prevent rattle when in a retracted position in the golf club shaft.

2. The supporting device according to claim 1, wherein the distal end further comprises a foot.

3. The supporting device of claim 2, wherein the foot is made from an organic, synthetic material or a combination thereof.

4. The supporting device of claim 3, wherein the foot is detachable from the distal end or is fixed thereto.

5. The supporting device of claim 1, wherein the first arm and second arm extending from the proximate end to a mid-portion define a widening gap between the first direction and the second direction.

6. The supporting device of claim 1, wherein the first leg and the second leg extending from a mid-portion to the distal end define a widening gap between the first direction and second direction.

7. The supporting device of claim 6, wherein an angle defining the gap between the first direction and the second direction is from about 1 degree to about 359 degrees.

8. The supporting device of claim 1, wherein a first bend and a second bend of a mid-portion are above the height of the distal end and proximal end.

9. The supporting device of claim 1, wherein the first leg and the second leg extending downwards from a mid-portion to the distal end, define a curved structure.

10. The supporting device of claim 1, wherein the first arm and second arm extend in an upward first and second direction from the proximate end to a first bend and a second bend of a mid-portion.

11. The supporting device of claim 1, wherein the device is made from an organic, synthetic material or a combination thereof.

12. The supporting device of claim 11, wherein the material is flexible.

13. A method for supporting a golf club handle up off a ground surface comprising:

partly inserting a supporting device for use in cooperation with the golf club shaft comprising:

a proximate end and a distal end, a first arm extending in a first direction from the proximate end and a second arm extending from the proximate end in a second direction offset from the first direction; and a first leg and a second leg extending from the respective said first arm and said second arm and at least one of said arms including a stop means at a juncture with the leg associated with said at least one arm, and intermediate the proximate end and the distal end into the golf club handle when playing the stroke of choice;

pulling the device out of the club handle at a predetermined length and resting a distal end of the device on to the ground and before the next golf shot reinserting the device back in to the golf club handle.

* * * * *